United States Patent [19]

Van Goethem et al.

[11] 3,941,598

[45] Mar. 2, 1976

[54] COMPLEXING RESIDUAL PHOTOSENSITIVE POLYHALOGEN COMPOUND WITH THE TERTIARY AMINE

[75] Inventors: Hugo Vital Van Goethem, Edegem; Edwin Hendrik Hazenbosch, Mechelen; Albert Lucien Poot, Kontich, all of Belgium

[73] Assignee: AGFA-Gevaert N.V., Mortsel, Belgium

[22] Filed: July 6, 1973

[21] Appl. No.: 376,965

[30] Foreign Application Priority Data

July 10, 1972 United Kingdom ..... 32149/72

[52] U.S. Cl. ..... 96/48 R; 96/90 R; 96/90 PC; 96/76 R; 260/268 T

[51] Int. Cl.[2] ..... G03C 5/24; G03C 1/48

[58] Field of Search .... 96/90 R, 90 PC, 48 R, 76 R; 260/268 T

[56] References Cited

UNITED STATES PATENTS

| | | | |
|---|---|---|---|
| 3,502,476 | 3/1970 | Itano et al. | 96/48 R |
| 3,525,616 | 8/1970 | Hackman et al. | 96/90 R |
| 3,660,094 | 5/1972 | Poot | 96/90 PC |
| 3,697,276 | 10/1972 | Lewis et al. | 96/90 R |
| 3,764,334 | 10/1973 | Wainer et al. | 96/90 R |

FOREIGN PATENTS OR APPLICATIONS

| | | | |
|---|---|---|---|
| 1,274,655 | 8/1968 | Germany | 96/90 PC |

OTHER PUBLICATIONS

Chemical Abstract, Vol. 75, 1971, 68977c.

*Primary Examiner*—Won H. Louie, Jr.
*Attorney, Agent, or Firm*—William J. Daniel

[57] ABSTRACT

A recording process including image stabilization comprising the steps of:

1. image-wise exposing to active radiation of a recording material containing in a recording layer a photosensitive polyhalogen compound capable of producing photoradicals when exposed with ultraviolet radiation, and
2. transforming the non-decomposed polyhalogen compound into a non-photosensitive substance in an element or body separate or separable from the recording layer by reaction with an aliphatic or cyclo-aliphatic tertiary amine.

19 Claims, No Drawings

COMPLEXING RESIDUAL PHOTOSENSITIVE POLYHALOGEN COMPOUND WITH THE TERTIARY AMINE

The present invention is directed to a recording method for forming a permanent or stabilized image resulting from the information-wise exposure of a free radical photosensitive material as hereinafter defined, wherein said method includes the inactivation of the photosensitivity of the compound producing the free radical.

By the term "free radical photosensitive material" employed in the present description is meant a photosensitive material in which at least one of the photosensitive ingredients is an ultraviolet sensitive organic polyhalogen compound producing photoradicals on exposure with said radiation.

Photographic dye-forming systems based on the use of said polyhalogen compound and a dye precursor compound have been described, e.g., by R. A. Fotland in J.phot.Sci., 18 (1970) 33–37, in the U.S. Pat. Nos. 3,102,810, 3,328,744 and 3,377,167, the United Kingdom Patent Specification No. 1,073,345 and in the Belgian Patent Specification Nos. 771,848, 787,339, 786,973 and 790,340 corresponding with the United Kingdom Patent Application Nos. 41,749/70, 42,802/71, 40,349/71 and 48,804/71 respectively.

In all these dye-forming systems carbon tetrabromide and/or iodoform are the most commonly used photoradicalgenerating compounds because these compounds excel in photosensitivity when compared with other representatives of the class of photosensitive organic polyhalogen compounds.

One of the presently known stabilization techniques makes use of the volatility of the carbon tetrabromide, which can be removed from the non-exposed portions of the recording material relatively easily by evaporation. A suitable stabilization temperature is e.g. in the range of 100° to 150°C.

The evaporation of carbon tetrabromide in the environment of the operating personel poses, however, a problem since the compound is physiologically not inert and classified as being toxic (see I. Sax, Dangerous Properties of Industrial Materials (1968).

The toxicity problem still remains when applying another commonly used stabilization technique that is based on the extraction of the photosensitive polyhalogen compound.

In the known extraction-stabilization technique a solvent for the photosensitive polyhalogen compound is used, which solvent does not affect or only weakly affects the binding agent of the recording layer. Some solvents such as diethyl ether, although being excellent extraction agents cannot be used for the risk of explosion. Other suitable extraction solvents belonging to the class of liquid halogenated aliphatic hydrocarbons are not miscible with water and may not be drained off in the sewer.

Now a recording process has been found including image stabilization comprising the steps of:

1. in age-wise exposing to active radiation of a recording material containing in a recording layer a photosensitive polyhalogen compound capable of producing photoradicals when exposed with ultraviolet radiation, and
2. transforming the non-decomposed polyhalogen compound in an element or body separate or separable from the recording layer into a non-photosensitive substance by reaction with an aliphatic or cycloaliphatic tertiary amine.

According to one mode of operation the non-decomposed photo-sensitive polyhalogen compound is inactivated outside the recording material and therefore first removed from the exposed recording material by evaporation. While being in the evaporated state said polyhalogen compound is brought into active chemical contact with said amino compound. For example, the air polluted with the polyhalogen compound is led through a container, capsule or flask containing optionally in the presence of a filler a finely divided e.g. dissolved aliphatic or cycloaliphatic tertiary amine, which complexes the polyhalogen compound.

According to another mode of operation the photosensitive polyhalogen compound is extracted from the exposed recording material with a solvent. The transformation of the photosensitive polyhalogen compound into a non-photosensitive species proceeds in the extracting liquid.

According to still another mode of operation the nondecomposed photosensitive polyhalogen compound is inactivated in a structural element or part e.g. a layer of the recording material. This proceeds e.g. by using onto the recording layer a covering layer in which the photosensitive polyhalogen compound being residual after the image-wise exposure is transferred e.g. by heating and evaporation and is allowed to react with said amine.

The fixing of the photosensitive polyhalogen compound such as carbon tetrabromide or iodoform in an element or body separate or separable from the recording material allows the regeneration of the photosensitive polyhalogen compound since the complex formed with said polyhalogen compound and an aliphatic or cycloaliphatic tertiary amine can be brought to dissociation by the action of an acid preferably an acid capable to lower the pH to at least 1 e.g. hydrochloric acid. For example up to 80 % of carbon tetrabromide can be recovered when said complex is allowed to react in an aqueous medium acidified with hydrochloric acid. In the aqueous medium carbon tetrabromide separates as a crystalline solid and can be removed e.g. by filtration, decantation, centrifugation or other known solid liquid separation techniques.

Taking into account the preceding, according to a first preferred embodiment of image stabilization the non-decomposed photosensitive polyhalogen compound is extracted from the recording material with a non-water-miscible solvent or solvent mixture and in such liquid complexed by the addition of said amine. The solvent is chosen in such a way that formed complex precipitates as a solid. The solid complex is then treated with an acidic aqueous solution by means of which the photosensitive polyhalogen compound such as carbon tetrabromide is set free again. Non-water-miscible liquids suitable for use in said embodiment are liquid polyhalogenated aliphatic hydrocarbon compounds, e.g., perchloroethylene. By the treatment with acid, preferably hydrochloric acid, the basic tertiary amine is converted in the corresponding salt, from which it can be set free again with a stronger base e.g. sodium hydroxide. By operating that way the tertiary amine can be recycled and play again its role of complexing and fixing agent for the photosensitive polyhalogen compound to be removed from an exposed recording material.

According to a preferred modification of said first embodiment the stabilization of the photoexposed recording material containing residual photosensitive polyhalogen compound proceeds by the steps of:

1. overall heating the recording material after its image-wise photo-exposure, characterized in that the heating proceeds in such a degree that the photosensitive organic polyhalogen compound accumulates at the outer surface or just near that surface of the recording material (when using carbon tetrabromide said heating proceeds preferably at about 85°C), and
2. extracting with a solvent or solvent mixture at moderate temperature, preferably between about 10° and about 30°C, the photosensitive polyhalogen compound that has moved towards the surface of the recording material.

The photosensitive polyhalogen compound being dissolved in the extracting liquid is converted into a photostable complex with a tertiary aliphatic or cycloaliphatic amine, whereupon the extracting liquid is freed from the complex in a way as described above and recycled in the stabilizing process.

The heating may proceed by contacting the rear side of the recording material, in other words the support of the recording layer, with a hot body kept at a temperature of preferably 80° to 120°C. Suitable supports that allow such heating without substantial distortion are, e.g., polyethylene terephthalate sheets of a minimum thickness of 50 $\mu$.

According to a second preferred embodiment the stabilization of the photo-exposed recording material containing residual photosensitive polyhalogen compound proceeds by overall heating the recording material after its image-wise photo-exposure in such a way that the polyhalogen compound migrates from the recording layer and penetrates into another layer in which the complexing amine is present.

In that embodiment preferably use is made of a recording material containing the photosensitive polyhalogen compound in a hydrophobic binder medium layer covered with a layer containing a hydrophilic resin or colloid e.g. gelatin and incorporating the tertiary amine. By that covering layer the tertiary amine has to be kept away from chemical contact with the photosensitive polyhalogen compound during storage and photoexposure of room temperature as much as possible. In order to avoid a premature contact the recording layer may be coated with an intermediate layer e.g. a non-polar resin or wax layer not accepting the amine but allowing carbon tetrabromide to penetrate, e.g., when heated above 80°C.

When using the tertiary amine in the recording material it is preferred to use an amine that can be distributed on a molecular scale in the hydrophilic binder. In the embodiment using the tertiary amine in the recording material the complex formed with the photosensitive polyhalogen compound is preferably colourless or only faintly coloured, e.g. has a faint yellow colour not substantially affecting the image quality.

According to a modification of said second embodiment the tertiary amine is incorporated into a removable layer covering the recording layer. For that purpose the covering layer preferably contains a binder medium that allows wash-off or stripping. An aqueous wash-off technique can be applied when using in the covering layer hydrophilic colloids that can be dissolved or removed in cold or hot water as described, e.g., in U.K. Patent Specification No. 1,139,891, and U.K. Patent Specification No. 1,264,313. Preferred hydrophilic colloids for that purpose are gelatin, animal glue and other proteinaceous colloids used in the manufacture of photographic materials, polyvinyl alcohol, partially saponified polyvinyl acetate, carboxymethylcellulose, ethylcellulose, poly-N-vinylpyrrolidone and polyacrylic acid amide.

The binding agent(s) of the recording layers of the free radical photosensitive materials described in the above mentioned patent specifications and applications is (are) of the hydrophobic type. Preference is given to polystyrene and poly-N-vinylcarbazole; the latter binding agent improves the photosensitivity of the recording layer especially when it contains spiropyran compounds as dye precursors for pyrylium or indolinium dyestuff salts.

A particularly preferred stabilizing agent for use according to the present invention is triethylenediamine also known as 1,4-diazo-2,2,2-bicyclo-octane having the following chemical structure:

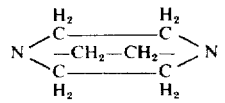

The triethylenediamine is a secondary product in the preparation of ethylenediamine (Beilstein 4, 249). It is marketed by Houdry Process Corp. USA and by Schuckardt (Munchen) W-Germany under the trade name DABCO.

The triethylenediamine forms a 1:1 complex with carbon tetrabromide.

For stabilization in the recording material itself the triethylenediamine is preferably used in an amount within the range of 2 g to 6 g per sq.m in a hydrophilic layer covering a hydrophobic photo-sensitive recording layer containing carbon tetrabromide in an amount of from 0.5 g to 4 g per sq.m.

Hexamethylenetetramine forms a crystalline 1:1 complex with iodoform. Preferred solvents for allowing the complex formation of carbon tetrabromide with triethylenediamine are aliphatic halogenated hydrocarbon liquids e.g., perchloroethylene.

Recording materials that are particularly suited for a stabilization technique as described in the present invention contain carbon tetrabromide in admixture with a spiropyran compound as dye precursor forming on exposure to active electromagnetic radiation a dye having a pyrylium salt or indolinium salt structure. Particularly suitable spiropyran compounds have been described in the published German Patent Application No. P 2,142,966. A preferred binding agent for recording layers containing said spiropyran compounds is poly-N-vinylcarbazole.

The present invention is illustrated by the following examples. EXAMPLE 1

On a polyethylene terephthalate support having a thickness of 62 $\mu$m the following composition is coated at a ratio of 80 g/sq.m:

| | |
|---|---|
| carbon tetrabromide | 3.72 g |
| iodoform | 3.72 g |
| 3-methyl-di-$\beta$-naphthospiropyran | 3.72 g |
| triphenylstibine | 0.70 g |
| 2-mercaptobenzothiazole | 1.82 g |
| polyethylene isophthalate (dissolved in 20 g of methylenechloride) | 0.80 g |

-continued

| | | |
|---|---|---|
| a 5% solution of poly-N-vinylcarbazole in methylene chloride | 220 | g |
| dichloroethane | 200 | g |

This material is processed in the following mode:

1. exposure with a U.V.-radiation source (mercury vapour lamp of 1,000 W) for 5 sec. at a distance of 10 cm.
2. heating of the material in a closed cabinet at a temperature of 180°C for 1 min.

The material has stabilized now and presents a copy having reversed image-values with respect to the original.

The air in the closed cabinet, which contains carbon tetrabromide, is led through a tube containing 4 g of triethylenediamine and 20 g of a silica-filler viz. CELLIT (trade name).

The thus treated air is free of carbon tetrabromide.

EXAMPLE 2

The material as described in Example 1 is processed in the following way:

1. exposure to an U.V.-radiation source (mercury vapour lamp 1,000 W) for 5 sec. at a distance of 10 cm;
2. heating of the material at 85°C on heated rollers or a metal plate for 15 sec.
3. immersion in perchloroethylene for 15 sec. at room temperature (20°C).

The material has stabilized now and represents a copy having reversed image values with respect to the original.

The solvent containing carbon tetrabromide can be recycled through a tube containing DABCO (trade name) and CELLIT (trade name) in a proportion of 1:5 by weight.

The solvent is freed completely from carbon tetrabromide.

In the tube the complex $CBr_4$-triethylenediamine is formed.

EXAMPLE 3

On a polyethylene terephthalate support of a thickness of 62 $\mu$m the following composition is coated at a coverage of 80 g/sq.m:

| | | |
|---|---|---|
| carbon tetrabromide | 7.44 | g |
| 3-methyl-di-$\beta$-naphthospiropyran | 3.72 | g |
| triphenylstibine | 0.70 | g |
| 2-mercaptobenzothiazole | 1.82 | g |
| polyethylene isophthalate | 0.80 | g |
| a 5% solution of poly-N-vinylcarbazole in methylene chloride | 220 | g |

On top of this layer a second layer is coated at a coverage of 50 g/sq.m and with the following composition:

| | | |
|---|---|---|
| DABCO (trade name) | 15 | g |
| a 20% solution of gelatin in water | 250 | g |
| water | 235 | g |

This material is processed in the following way:

1. exposure to a U.V. radiation source (mercury vapour lamp 1000 W) at a distance of 10 cm for 5 sec.;
2. heating on heated rollers or metal plate on 110°C for 10 sec.

A copy having reversed image values with respect to the original is obtained. The material shows no colouration when further exposed to active electromagnetic radiation.

We claim:

1. In a recording process comprising the step of image-wise exposing to an activating radiation image a recording layer containing:

a. a polyhalogen hydrocarbon compound releasing free radicals by photolytically decomposition when exposed to activating radiation, and b. A dye precursor compound reactive upon contact with said free radicals released in the exposed areas of said layer to produce a colored dye image, the improvement of stabilizing the unexposed regions of said layer by the steps of:

removing residual undecomposed polyhalogen compound from said layer and contacting the removed polyhalogen compound with a cycloaliphatic tertiary amine reactive with said polyhalogen compound to form a solid non-light-sensitive complex.

2. The process of claim 1 wherein said polyhalogen compound is removed by contacting the layer with a non-water miscible solvent to extract the same from said layer, separating said solvent from said layer, and adding to the separated solvent said amine in an amount sufficient to form said complex.

3. The process of claim 2 wherein said solvent is at a temperature of about 10°–30°C.

4. The process of claim 1 wherein said polyhalogen compound is removed by uniformly heating said layer to volatilize said polyhalogen compound and the volatilized compound is brought into contact with said amine.

5. The process of claim 4 wherein said layer is heated to a temperature of about 80°–120°C.

6. The process of claim 1 wherein said polyhalogen compound is removed by uniformly heating said layer to volatilize the residual compound while said layer is arranged in sandwich relation with a separate layer containing said amine, whereby said volatilized compound is transferred to said separate layer and complexes with said amine therein.

7. The process of claim 6 including the step of removing said separate layer from said sandwich relation after said heating.

8. The process of claim 6 wherein said separate layer comprises a hydrophilic binder containing said amine.

9. The process of claim 1 including the steps of treating said complex with an acidic medium to dissociate the same whereby said polyhalogen compound separate from said medium and recovering the thus separate polyhalogen compound from said medium.

10. The process of claim 9 wherein said medium has a pH of 1 or below.

11. The process of claim 9 wherein the amine is recovered from said acidic medium by adding thereto a base stronger than said amine.

12. The process of claim 1 wherein said exposing radiation includes ultraviolet light.

13. The process of claim 1 wherein said amine is triethylenediamine.

14. The process of claim 1 wherein the recording material contains a recording layer comprising carbon tetrabromide and a spiropyran compound as dye precursor compound.

15. A recording material comprising a recording layer containing:

a. a polyhalogen hydrocarbon compound releasing free radicals by photolytically decomposition when exposed to activating radiation, and b. a dye precursor compound reactive upon contact with said free radicals released in the exposed areas of said layer to produce a colored dye image, in sandwich relation with said recording layer a stabilizing layer containing a cycloaliphatic tertiary amine reactive with said polyhalogen compound to form a solid non-lightsensitive complex, whereby residual polyhalogen compound in said layer after exposure thereof to said activating radiation is transferable to said stabilizing layer by heating to volatilize said residual compound.

16. The material of claim 15 wherein said stabilizing layer is separated from said recording layer by a vapor-permeable intermediate layer.

17. The material of claim 15 wherein the tertiary amine is triethylenediamine.

18. The material of claim 15 wherein the amine is used in an amount of 2 to 6 g per sq.m and the polyhalogen compound in an amount of from 0.5 to 4 g per sq.m.

19. The material of claim 15 wherein the recording layer contains poly-N-vinylcarbazole as binding agent.

* * * * *